United States Patent [19]

Aoki et al.

[11] 4,022,017

[45] May 10, 1977

[54] FULL ELECTRONIC CAR CLOCK WITH DIGITAL DISPLAY AND METHOD OF TIME SETTING THEREFOR

[76] Inventors: Motomu Aoki, 100-23 Nishikanenoi, Showa Kitakatsushika, Saitama; Akira Ishikawa, 13-4, 3-chome, Kamirenjaku Mitaka, Tokyo, both of Japan

[22] Filed: Aug. 14, 1975

[21] Appl. No.: 604,778

Related U.S. Application Data

[63] Continuation of Ser. No. 407,045, Oct. 17, 1973, abandoned.

[30] Foreign Application Priority Data

| | | |
|---|---|---|
| Oct. 25, 1972 | Japan | 47-106860 |
| Feb. 22, 1973 | Japan | 48-21605 |
| Mar. 3, 1973 | Japan | 48-25584 |
| Mar. 20, 1973 | Japan | 48-32129 |

[52] U.S. Cl. ..... 58/145 R; 58/23 R; 58/50 R; 58/85.5

[51] Int. Cl.[2] ..... G07C 5/04; G04B 19/30; G04C 3/00; G04B 27/00

[58] Field of Search ..... 58/23 R, 39.5, 50 R, 58/85.5, 145, 152 R

[56] References Cited

UNITED STATES PATENTS

| | | | |
|---|---|---|---|
| 3,576,099 | 4/1971 | Walton | 58/23 R |
| 3,757,509 | 3/1972 | Fujita | 58/23 R |
| 3,854,277 | 12/1974 | Samejima et al. | 58/39.5 |

*Primary Examiner*—E. S. Jackmon
*Attorney, Agent, or Firm*—Torne, McGeady and Stanger

[57] ABSTRACT

A fully electronic car clock with digital display is provided in which the counter circuit of the car clock is connected to a car battery through an engine key switch to be driven therefrom, and the clock display is interlocked with the engine key switch so as to be energized or deenergized in accordance with the ON-OFF position thereof in order to avoid draining the battery. A method of time setting the car clock is also proposed.

20 Claims, 8 Drawing Figures

BATTERY
1
+
-
19
20
21
22
ENGINE KEY SWITCH
2
IG
ST
B
OFF
VOLTAGE CONVERTER
5
TIME DISPLAY
11
CAR CLOCK
4
VOLTAGE STABILIZER
3
25

CLOCK SIGNAL SOURCE
FREQ. DIVIDER
GATE
SECOND COUNTER
GATE
MINUTE COUNTER
GATE
HOUR COUNTER
TIME DIVISION CIRCUIT
TIMING CIRCUIT
DECODER
INVERTER
INVERTER
TIMING CONTROL GATE
Vss VDD
Vss
IGO
ST
OFF
B
T
S
F
+
−
1
2
3
5
6
7
8
9
10
11
12a
13a
14a
15a
16
18
19
21
22
26
30
100
101
102
103
104
105
106
107
109
115
116
117
118
119

CLOCK SIGNAL SOURCE
6
FREQUENCY DIVIDER
101
SECOND SIGNAL GATE
105
SECOND COUNTER
102
MINUTE SIGNAL GATE
106
MINUTE COUNTER
103
HOUR SIGNAL GATE
107
HOUR COUNTER
104
EO-1
EO-2
AG-1
INV
110
GATE
OR-2
AG-2
TIME CONTROLLING GATE
109
AG-3
108
HOLD GATE
OR-1
TIME SETTING SWITCH
10
R
T
H
S
F
SW
VDD
27
DIGITAL CLOCK CIRCUIT
100

HOUR COUNTER
104
HOUR SIGNAL GATE
107
EO-2
MINUTE COUNTER
103
MINUTE SIGNAL GATE
106
EO-1
SECOND COUNTER
102
110
GATE
AG-1
OR-2
INV
105
SECOND SIGNAL GATE
101
FREQUENCY DIVIDER
6
CLOCK SIGNAL SOURCE
VDD
TIME SETTING SWITCH
10a
SW-1
R
T
H
TIME CONTROLLING GATE
AG-2
109
AG-3
AG-4
HOLD GATE
108
DIGITAL CLOCK CIRCUIT
100
10b
TIME SETTING SWITCH
SW-2
K
S
F

CLOCK SIGNAL SOURCE
6
FREQUENCY DIVIDER
101
SECOND SIGNAL GATE
105
SECOND COUNTER
102
MINUTE SIGNAL GATE
106
MINUTE COUNTER
103
HOUR SIGNAL GATE
107
HOUR COUNTER
104
EO-1
EO-2
AG-1
INV
AG-2
AG-3
AG-5
RESET GATE
111
TIME CONTROLLING GATE
109
DIGITAL CLOCK CIRCUIT
100
TIME SETTING SWITCH
10
VDD
OFF SW-R ON
OFF SW-H ON
OFF SW-S ON
OFF SW-F ON

FULL ELECTRONIC CAR CLOCK WITH DIGITAL DISPLAY AND METHOD OF TIME SETTING THEREFOR

This is a Continuation of application Ser. No. 407,045 filed Oct. 17, 1973 which is now abandoned.

DETAILED DESCRIPTION OF THE INVENTION

The invention relates to a fully electronic car clock with digital display interlocked with an engine key, and more particularly to such car clock in which the time display of the clock is energized or deenergized in accordance with the ON-OFF position of the engine key switch of a car while the counter circuit of the car clock continues operating, and also to such car clock which can be used as a stop watch by converting the hour and a minute display into minute and "second" display through a novel combination of a time setting switch circuit and a novel method of time setting. The invention also relates to a method of time setting such car clock.

A fully electronic clock with digital display is already known, but its application to a car clock has not been achieved in a satisfactory manner. While it may appear that a current on the order of several amperes may be readily derived from an electric storage battery of the type used in cars, the trend today is to use an ever increasing number of devices in cars, which results in a total power dissipation corresponding to the continuous illumination of the head lamps. This presents a problem to the battery life, the starting of the engine or the like, so that it is desirable that the power dissipation of the car clock be as small as possible. Although the power consumption from a D.C. 12 volt battery required to operate only the time counter circuit of a fully electronic car clock with digital display incorporating LSI (large scale integrated circuit) may be as little as 0.1 watt, the use of an LED (light emitting diode), fluorescent tube, Nixie tube, segmented neon tube, filament type display, PDP (plasma display panel) or the like to provide a time display causes a considerable increase in the power dissipation. By way of example, the total power dissipation of a digital car clock when four fluorescent tubes are illuminated to provide an indication of hours and minutes will increase power consumption by a factor of 9 as compared with the power dissipation required to operate the counter circuit alone. Thus it will be appreciated that the total power consumption of a car clock with digital display can be minimized without adverse influence upon the battery life if the time display is deactivated while maintaining the time counter circuit operative when the engine key switch is in the OFF position and the car is not in use. Because the time counter circuit continues operating, the correct time will be displayed when the engine key switch is turned on again.

The digital display for the car clock may include a liquid crystal display requiring a low power dissipation, but such a display has a limited life on the order of 10,000 to 20,000 hours. However, the life of such liquid crystal display could be extended by turning off the time display while maintaining the time counter circuit operative when the engine key switch is in the OFF position and the car is not in use. The liquid crystal display suffers from a poor contrast, which requires illumination of the display by an external light source. If this light source is also turned on and off together with the liquid crystal display by an interlock arrangement with the engine key switch, the power dissipation required for the light source can also be minimized. Additionally, certain luminescent displays have a decreasing brightness. For example, a fluorescent display tube may have an initial brightness of 200 foot lamberts, which is reduced to one-half such value after continuous use of 1 or 1½ years, and subsequently gradually decreases further. However, by turning off the display tube when the engine key switch is turned off, such reduction in the brightness of the display tube can be delayed.

It is a first object of the invention to provide a fully electronic car clock with digital display in which the time display of the car clock is turned on and off by an interlocking arrangement with an engine key switch which deactivates the display when the engine key switch is in the OFF position, thereby reducing the power dissipation and enabling the life of the display to be extended and a reduction in the brightness of the display to be delayed.

It is a second object of the invention to provide a method of time setting a fully electronic car clock with digital display in a simple and smooth manner so as to provide additional functions to the car clock other than its inherent clock function.

It is a third object of the invention to provide a fully electronic car clock with digital display incorporating individual time setting switches, a pair of time setting switches or a single multiple contact switch for the purpose of time setting, and in which the group of contacts of any of such time setting switches includes a reset circuit contact, clock operating contact, hold contact, minute adjusting contact, and hour adjusting contact so as to provide in a single car clock a stop watch function for rally purposes and a time integrating function by cooperation with a time setting operation, and also to provide a method of time setting the car clock in such manner.

Above and related objects, features and advantages of the invention will be apparent from a reading of the following detailed description thereof with reference to the drawings, in which.

DETAILED DESCRIPTION OF EMBODIMENTS

Figure 1:
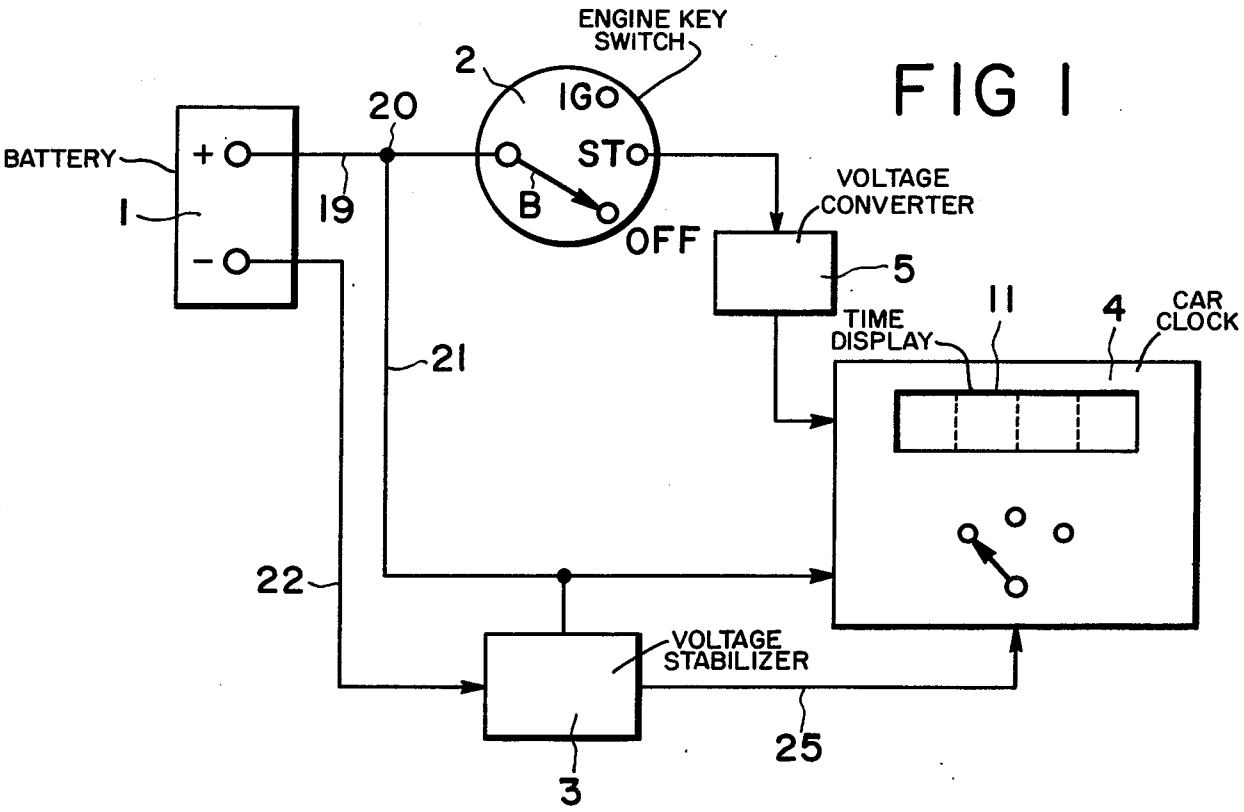
FIG. 1 is a schematic diagram of the fully electronic car clock with digital display interlocked with an engine key switch constructed in accordance with the invention.
Figure 2:
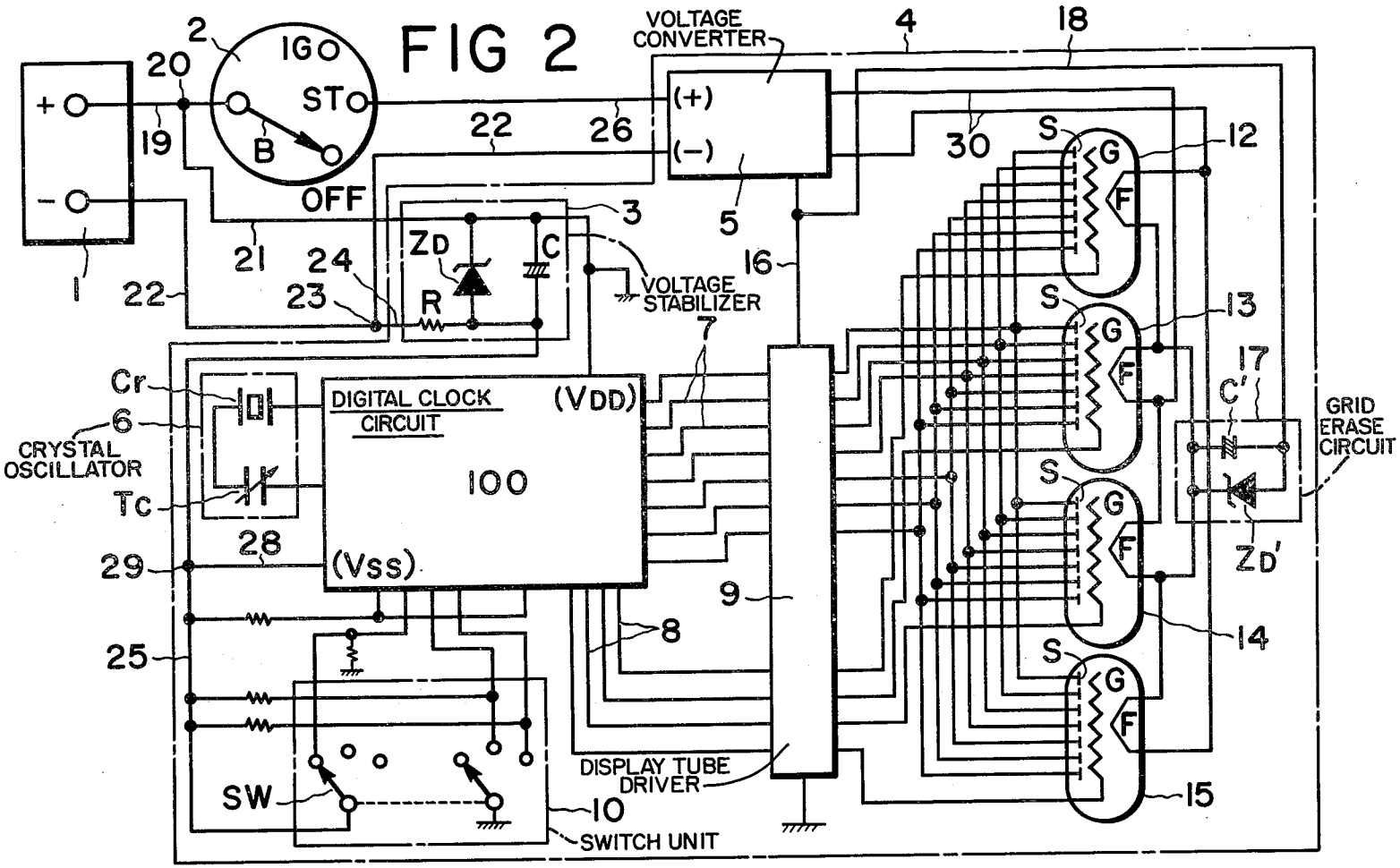
FIG. 2 is a circuit diagram of one embodiment of the car clock shown in FIG. 1 incorporating dynamically driven fluorescent display tubes for the time display thereof.

Referring to FIGS. 1 and 2, numeral 1 represents a conventional car battery. The engine key switch of the car is shown at 2, and has an engine stop position OFF, a run contact ST and an ignition contact IG. The engine key switch 2 is conventional in itself, and can be rotated to connect a common contact B with any of the contacts OFF, ST, or IG. A voltage stabilizer 3 is provided for stabilizing the supply voltage supplied to a large scale integrated digital clock circuit (LSI) 100. As illustrated in FIG. 2, the voltage stabilizer may comprise a Zener diode $Z_d$, capacitor C and a resistor R.

The full electronic car clock with digital display constructed in accordance with the invention is collectively shown at 4, and includes the LSI 100 mentioned above. A voltage converter 5 is provided for converting the supply voltage from the battery 1 into a voltage of suitable level to operate the display of the car clock. Except trucks, usual passanger cars use a battery voltage of D. C. 12 volts. However, the operational voltage to activate the display of the car clock is much higher than the battery voltage. To illustrate, an operational voltage in the range from D. C. 25 to 50 volts will be required to illuminate a fluorescent discharge tube dynamically, a voltage from D. C. 15 to 30 for liquid crystal display, and an operational voltage on the order of D. C. 200 volts for plasma display panel. The voltage converter 5 is provided for the purpose of such a voltage conversion. However, it should be noted that a certain display such as light emitting diode operates at a much lower voltage than the battery voltage of D. C. 12 volts as, for example, at a voltage of merely D. C. 2 volts, and therefore does not require the provision of the voltage converter 5.

The LSI 100 which constitutes the digital clock is connected to an external crystal oscillator 6 or a source of clock reference signal, which may comprise a quartz oscillator $C_r$ and a trimmer capacitor $T_c$ for adjusting the oscillation frequency of the quartz oscillator, as shown in FIG. 2.

As will be further described hereinbelow, the LSI 100 also includes a frequency divider which divides the oscillation frequency of the crystal oscillator 6, a "second" counter, a minute counter, an hour counter, a time controlling gate circuit and a 7-segment decoder which operates to cause the counter contents of hours, minutes and seconds to be displayed on a 7-segment display. At this end, segment signal lines 7 and arid control signal lines 8 are connected between the outputs of the LSI 100 and the inputs of a fluorescent display tube driver 9. The LSI 100 is also connected to an external switch unit 10, which permits the contents of the counters within the LSI 100 to be adjusted at will for the purpose of time setting in accordance with a manupulation of switches SW contained therein. In response to the segment signals and the grid control signals provided by the LSI 100, the driver 9 effects a switching action upon the high voltages which are applied to illuminate fluorescent display tubes 12, 13, 14 and 15 contained in a time display 11. The driver 9 comprises switching transistors capable of withstanding high voltages and resistors, and is connected between the ground and the negative terminal of the voltage converter 5 through a supply line 16. Each of the fluorescent display tubes 12, 13, 14 and 15 includes a filament F connected to an output from the voltage converter 5, a grid G connected to certain outputs of the driver 9, and a plurality of segments S. An emission of electrons occurs from the filament F when it is heated by the application of a voltage thereto, and such electrons can be directed to a particular segment S indicating a numeral which is determined by the counter content of the LSI 100 only when a high voltage is applied to the grid G and that particular sebment S, therby causing an emission of light from that segment. A grid erase circuit 17 is provided for erasing or removing the electrons which remain in selected fluorescent display tubes. The grid erase circuit 17 comprises a parallel combination of a Zener diode $Z_d'$ and a capacitor C', which combination is connected in a line 18 which connects the filament F of the fluorescent display tubes 12, 13, 14, 15 to the negative terminal of the voltage converter 5. The grid erase circuit 17 acts to apply a negative voltage to the grid of the respective fluorescent display tubes 12, 13, 14 and 15 for screening the electrons at the grid G and preventing them from flowing to the segment S, thereby maintaining the fluorescent display tubes inactive.

The positive terminal of the battery 1 is connected to the common contact B of the engine key switch 2 through a lead 19, and is also connected to the positive input of the voltage stabilizer 3 through another lead 21, this terminal being connected to the ground. The negative terminal of the battery 1 is connected to the negative input of the voltage converter 5 through a lead 22, and is connected to the other input of the voltage stabilizer 3 through a lead 24 which is connected to the lead 22 at junction 23. The voltage output from the voltage stabilizer 3 is applied through a lead 25 to the LSI 100 and the switch unit 10. It will be appreciated that where the negative terminal of the battery 1 is connected to the body of the car as an earth connection, a positive supply system may be employed. The run contact ST of the engine key switch 2 is connected to the positive input of the voltage converter 5 through a lead 26.

Figure 3:
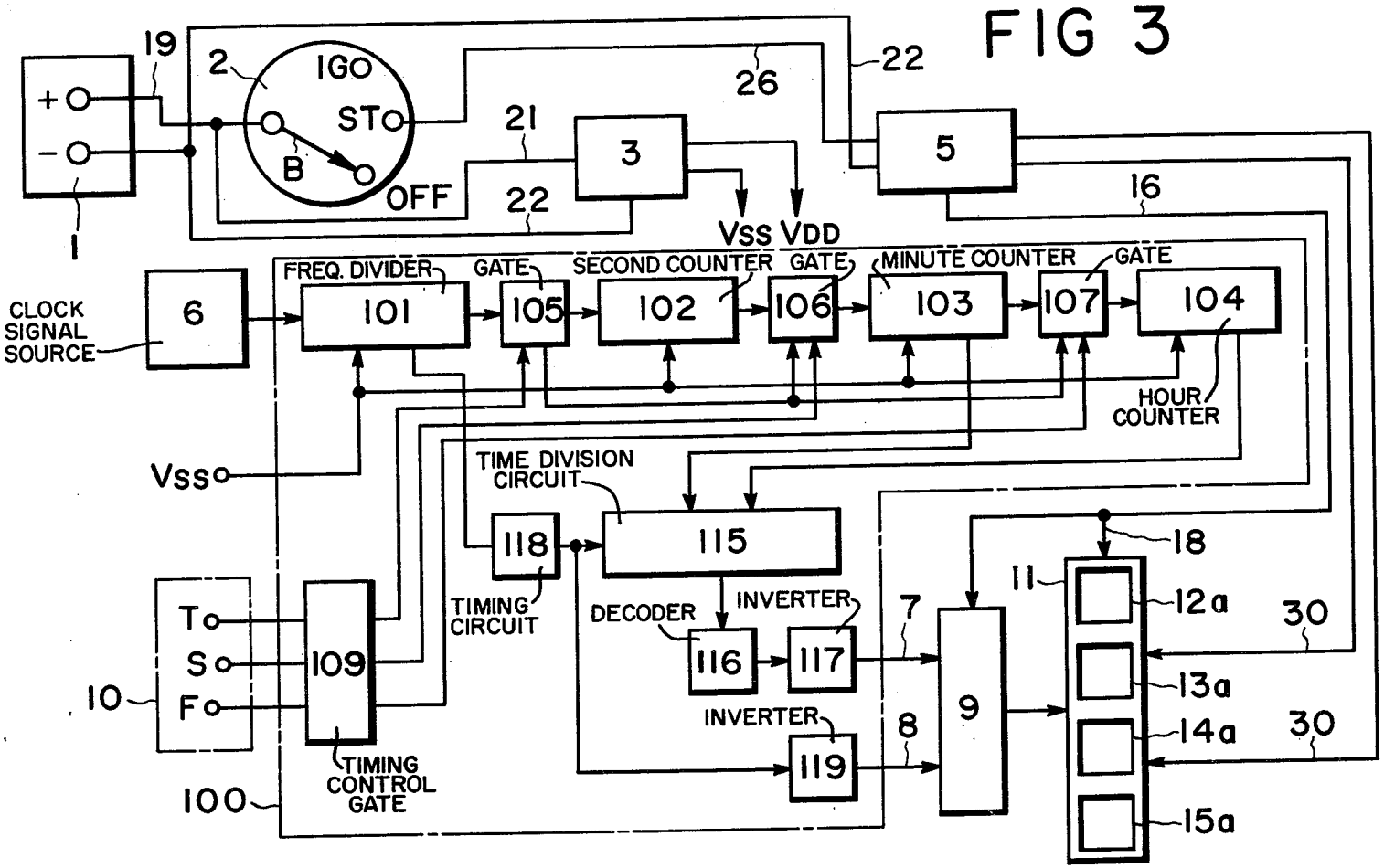
FIG. 3 is a block diagram of the LSI shown in FIG. 2.

An exemplary circuit arrangement of the LSI 100 which constitutes the digital clock is more fully illustrated in FIG. 3. Specifically, the LSI 100 includes a frequency divider 101, a "second" counter 102, a minute counter 103, an hour counter 104, a "second" signal gate 105, a minute signal gate 106, an hour signal gate 107 and a timing control gate 109. In addition, it includes a time division circuit 115 provided for the purpose of time display, a decoder 116 for converting a BCD code into a 7 -segment representation, a signal inverter 117, a timing circuit 118 and another signal inverter 119. The source of clock signal 6 such as the crystal oscillator as mentioned above is connected with the input of the frequency divider 101, produces a grid signal. The time display 11 which includes four fluorescent display tubes 12, 13, 14 and 15 as mentioned previously, constitutes a ten's digit hour display section 12*a*, a unit's digit hour display section 13*a*, a ten's digit minute display section 14*a* and unit's digit minute display section 15*a*, respectively. The numeral indicating signals from the hour counter 104 and the minute counter 103 are supplied to the inputs of the time division circuit 115, and the signals which are selected by this circuit in a sequential manner are supplied to the decoder 116 for conversion into 7-segment code, the output signal of which is fed through the inverter 117 to provide a 7-segment signal output 7 to the LSI 100. The grid signal from the frequency divider 101 is fed through the timing circuit 118 and through the inverter 119 to provide a grid signal output 8 to the LSI 100. The 7-segment signal output 7 and the grid signal output 8 are supplied to the driver 9 in order to provide a digital display of the content of the counters by means of the display sections 12*a*, 13*a*, 14*a* and 15*a* of the clock display 11.

key switch operation, when the common contact B of the engine keyswitch 2 is in the engine stop position OFF as shown in FIGS. 1 to 3, the positive terminal of the battery 1 is connected through the voltage supply leads 19, 21 and through the voltage stabilizer 3 to provide a drain voltage $V_{DD}$ to the LSI 100. The negative terminal $V_{SS}$ of LSI 100 is connected through a lead 28, junction 29, lead 25 and resistor R in the voltage stabilizer 3 to the negative terminal of the battery 1. Thus, when the engine key switch 2 is in its OFF position, no voltage is applied to the input of the voltage converter 5, so that the filaments F of the fluorescent display tubes 12 to 15 and the driver supply line 16 are not energized and the fluorescent display tubes remain unilluminated. Thus, the only load on the battery 1 is the power dissipation by the LSI 100.

When the common contact B of the engine key switch 2 is transferred to the run position ST, the positive terminal of the battery 1 is connected with both the voltage supply lines 19, 21 of the LSI 100 and the input lead 26 to the voltage converter 5. Because the negative terminal of both the LSI 100 and the voltage converter 5 is normally connected with the negative terminal of the battery 1, it will be seen that the LSI 100 continues its operation, while the voltage converter 5 is now energized for the first time. The voltage converter 5 produces high voltages (segment voltage and grid voltage), as well as low voltage (filament voltage), which are necessary to illuminate the fluorescent display tubes 12, 13, 14 and 15. The high voltages voltages produced by the voltage converter 5 are applied through the leads 16 and 18 to the driver 9 and the grid erase circuit 17, respectively, while the low voltage produced by the voltage converter 5 is applied to the respective filaments F of the fluorescent display tubes 12, 13, 14 and 15 through leads 30. Under this condition, each of the fluorescent display tubes 12, 13, 14 and 15 is operable to emit light in a pattern corresponding to the content of the respective counters to provide a time display.

FIGS. 4 to 8 illustrate other embodiments of the LSI 100 and the switch unit 10 which may be used in the full electronic car clock with digital display described above. The time setting function of the car clock in accordance with the invention will be described with reference to these embodiments. It should be noted that the relation of producing a time display with respect to the operation of the engine key switch in these embodiments is similar to that described in connection with FIGS. 1 to 3, and therefore will not be described in the following description in which only the switch unit used for time setting as well as the counter circuits will be shown and described.

Figure 4:
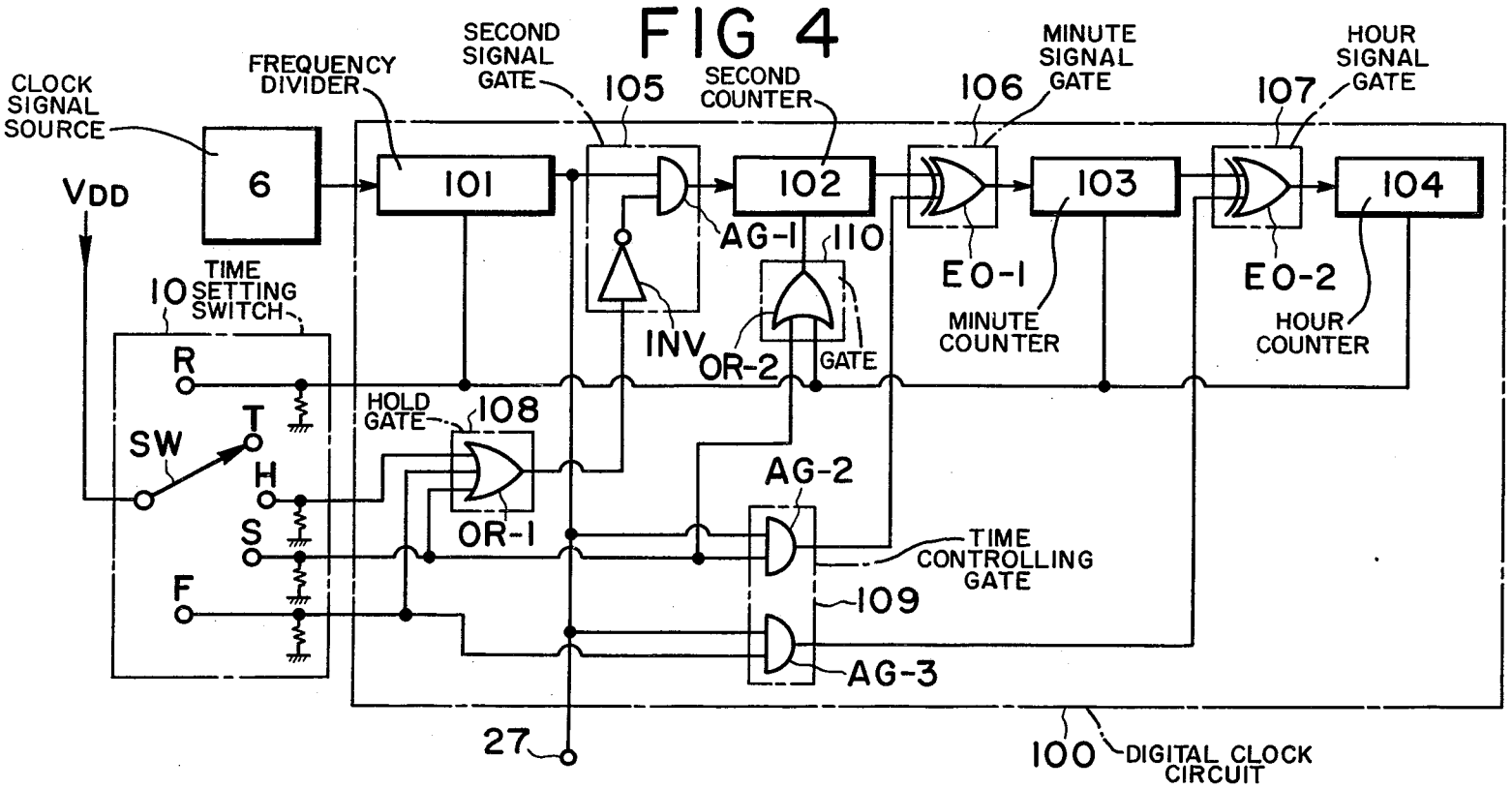
FIGS. 4 to 8 are block diagrams showing different embodiments of the time setting logic circuits applied to the car clock.

Referring to FIG. 4, the embodiment shown incorporates a single multiple contact switch as the time setting switch unit. As before, the LSI 100 includes a frequency divider 101, a "second" counter 102, a minute counter 103, and an hour counter 104 as well as various gate circuits including a "second" signal gate 105, a minute signal gate 106, an hour signal gate 107, a hold gate 108, a time controlling gate 109 and a "second" reset gate 110. As mentioned previously, the LSI 100 is connected with an external source of clock signal 6 such as a crystal oscillator, the signal therefrom being fed into the input of the frequency divider 101. Also the LSI 100 is associated with an external time display (not shown) which comprises a ten's digit hour display section, unit's digit hour display section, ten's digit minute display section and unit's digit minute display section connected with the circuits which provide numeral indicating signals from the hour 104 and the minute counter 103 in order to provide a digital display of the content of the hour counter 104 and the minute counter 103. However, such an arrangement has been described in connection with the previous embodiment, and therefore will not be repeated.

A change-over switch comprising a rotary switch or a sliding switch 10 is provided externally of the LSI 100 which constitutes the digital clock, the switch having a contact designated as clock signal input position T which remains unconnected, so as not to apply a signal to the LSI 100; another contact designated as hold contact H which is connected to the input circuit of the hold gate 108; a further contact designated as minute adjusting contact S which is connected with the input circuits of the hold gate 108, AG-2 gate within the time controlling gate 109, and the "second" reset gate 110; an additional contact designated as hour adjusting contact F which is connected with the input circuits of AG-3 gate within the time controlling gate 109 and the hold gate 108; and finally an yet further contact designated as reset contact R which is connected with the reset input circuits of the hour counter 104, the minute counter 103, "second" counter 102 and all of frequency division counter circuits within the frequency divider 101, the connection with the "second" counter 102 being effected through the "second" reset gate 110. The change-over switch 10 includes a common contact SW connected with a source of operating voltage $V_{DD}$, which may be connected with either one of the clock signal input position T, hold contact H, minute adjusting contact S, hour adjusting contact F and reset contact R. The arrangement is such that the circuit connected with a particular contact which is electrically connected with the common contact SW is applied with a voltage $V_{DD}$ representing a logical "1 ", while the circuits connected with the remaining contacts are connected to the ground through respective resistors, thus representing a logical "0 ". In the description to follow, it is assumed that the circuit is designed to operate on a logical "1 " signal even though a circuit arrangement may be made to operate on a logical "0 ".

The "second " signal gate 105 comprises a gate AG-1 and an inverter INV. The minute signal gate 106 comprises a gate EO-1. The hold gate 108 comprises an OR-1 gate, while the time controlling gate 109 comprises AG-2 gate and AG-3 gate. The "second" reset gate 110 comprises an OR-2 gate, while the hour signal gate 107 comprises an DO-2 gate. The AG-1 gate within the "second" signal gate 105 and the AG-2 and AG-3 gates within the time controlling gate 109 represent AND gates, which operate to provide a logical "1 " output only when all of the inputs thereto are logical "1 "s. Thus, when one input is a logical "1 " while the other input is a logical "0 ", the output from the AND gate is a logical "0 ". When all of the inputs are logical "1 "s, the AND gate provides a logical "1 " output. The OR-1 within the hold gate 108 as well as OR-2 within the "second" reset gate 110 represent an OR gate, which provides a logical "0 " output when the inputs are logical "0 "s, but which provides a logical "1 " output when either one of the inputs is a logical "1 ". EO-1 which constitutes the minute signal gate 106 as well as EO-2 which constitutes the hour signal gate 107 represent exclusive OR gates, which provide a logical "0 " output when the both inputs are logical "0 "s or when the both inputs are logical "1 "s. However, an exclusive OR gate produces a logical "1 " output when the inputs are dissimilar. INV within the "second" signal gate 105 represents an inverter which produces a logical "1 " output when the input thereto is a logical "0 " and produces a logical "0 " output when the input is a logical "1 ".

In the description to follow, the expression that a signal is inputted (or outputted) represents that a signal of logical "1 " is applied (or produced), while the expression that a signal is not outputted (or inputted) refers to a logical "0 ". In the LSI 100, the output of the frequency divider 101 is connected with one input of AG-1 gate within the "second" signal gate 105 as well as one input of AG-2 and AG-3 gates within the time controlling gate 109. It is also connected to a "second" output terminal 27 provided externally of the LSI 100. The output of OR-1 gate in the hold gate 108 is connected through an inverter INV in the gate 105 to the other input of AG-1 gate within the gate 105. The output of AG-2 gate within the time controlling gate 109 is connected with one input of EO-1 gate in the minute signal gate 106. The output of AG-3 gate in the same gate 109 is connected to one input of EO-2 gate in the hour signal gate 107.

During the normal use of the car clock, the common contact SW of the change-over switch 10 is connected with the clock signal input position T. Thus, the reset contact R, hold contact H, minute adjusting contact S and hour adjusting contact F and their connecting circuits remain at a logical "0 " level. Because the input to the inventer INV of the "second" gate 105 is a logical "0 ", it provides a logical "1 " output. The clock signal from a source of clock signal 6 is applied to the frequency divider 101, which comprises a plurality of flipflop stages (not shown) which count down the input pulses, thereby providing a "second" signal of one pulse per "second" from the output of the frequency divider 101. The "second" signal is inputted to AG-1 gate in the "second" signal gate 105, and to AG-2 and AG-3 gates in the time controlling gate 109 as well as to the "second" output terminal 27. The "second" signal inputted to two input AND gate AG-1 of the "second" signal gate 105 is passed therethrough, since the output of the inverter INV of the gate 105 is at logical "1 " level, whereby the "second" signal is inputted to the "second" counter 102. The "second" counter 102 is a scale of 60 counter circuit comprising a plurality of flipflop stages and gates, not shown, and produces one pulse every time it has counted 60 "second" signals inputted thereto at a rate of one pulse per "second", thereby providing a minute signal produced once every 60 "seconds". The minute signal is passed through EO-1 gate in the minute signal gate 106 to be inputted into the minute counter 103. The minute counter also comprises a scale of 60 counter circuit including a combination of a plurality of flipflop stages and gates, not shown, and produces one pulse output every time it has counted 60 minute signals inputted thereto, thereby providing an hour signal produced at a rate of one per 60 minutes. The hour signal is passed through EO-2 gate in the hour signal gate 107 to be inputted into the hour counter 104. The hour counter 104 comprises a scale of 12 or 24 counter circuit including a combination of a plurality of flipflop stages and gates, not shown, and is adapted to cyclically count 12 or 24 hour signals inputted thereto.

In this manner, during the normal use of the clock, the clock signal of the source 6 is inputted to the frequency divider 101, the output of which is produced as a "second" signal at a rate of one pulse per "second", which is inputted into the "second" counter 102, the output of which is produced as a minute signal at an interval of one minute. The minute signal is inputted into the minute counter 103, which produces an hour signal at an interval of one hour, which hour signal is inputted into the hour counter 104, thereby performing the counting of hours, minutes and "seconds". The contents of the counters are applied to a digital display. In a clock incorporating a scale of 12 hour counter, a cyclical time counting proceeds from 00 hour 00 minute to 11 hour 59 minute and returns to 00 hour 00 minute. In a clock incorporating a scale of 24 hour counter, a cyclical time counting proceeds from 00 hour 00 minute to 23 hour 59 minute and returns to 00 hour 00 minute. If desired, a scale of 60 hour counter 104 may be used to provide a cyclical time counting from 00 hour 00 minute to 59 hour 59 minute and returning to 00 hour 00 minute. It should be understood that a display of the counte time is simultaneously provided by the clock display mentioned previously. As an alternative, a "second" display may be provided and applied with a "second" indicating signal from the "second" counter 102 to provide a cyclical display of "seconds" from 00 "second" to 59 "second" and returning to 00 "second".

Considering now the method of time setting, it is assumed that the display provided by the car clock is slightly advanced with respect to the correct time. In this instance, the common contact SW of the change-over switch 10 is turned so as to be connected to the hold contact H. When the common contact SW is connected with the hold contact H, the circuit connected with the hold contact H assumes a logical "1 " level, whereby a logical "1 " is applied through OR-1 gate in the hold gate 108 to the input of the inverter INV in the "second" signal gate 105. As a consequence, the output of the inverter which is connected with one input of AG-1 gate in the gate 105 becomes a logical "0 " to disable it, whereby AG-1 gate can no longer pass a signal inputted thereto. At this time, both AG-2 and AG-3 gates in the time controlling gate 109 also disabled, so that while the signal outputted from the frequency divider 101 is inputted to each of AG-1, AG-2 and AG-3 gates, these gates can not produce an output signal. The resulting absence of a "second" signal to the input of the "second" counter 102 prevents further counting by each of the counters 102, 103 and 104, whereby the time representation in each of these counters remain unchanged as does the clock display. As the time goes on and becomes coincident with the time representation maintained in the display of the car clock, the common contact SW of the change-over switch 10 is returned to the clock signal input position T, whereupon the input to the inverter INV of the "second" signal gate 105 returns to a logical "0 " level to thereby produce a logical "1 " output, enabling AG-1 gate of the gate 105 even though AG-2 and AG-3 gates in the time controlling gate 109 remain disabled. Now the signal from the frequency divider 101 is passed through AG-1 gate to be inputted into the "second" counter 102, therby enabling normal time counting to proceed together with the corresponding display. When a deviation from the correct time is greater, the common contact SW of the change-over switch 10 may be moved to the minute adjusting contact S or the hour adjusting contact F to cause a time counting in the corresponding counter and the time representation in the associated display to proceed at an accelerated rate. Thus, when the common contact SW is connected with the hour adjusting contact F, a logical "1 " on the line connected with the contact F is applied through OR-1 gate in the hold gate 108 to the input of the inverter INV of the "second" signal gate 105, so that a logical "0 " signal is applied to one input of AG-1 gate to disable it, whereby a "second" signal can not be inputted into the "second" counter 102. Simultaneously, a logical "1 " signal is applied to one input of AG-3 gate in the time controlling gate 109 which is connected with the hour adjusting contact F to thereby enable AG-3 gate, so that a "second" signal continuously supplied from the output of the frequency divider 101 at a rate of one pulse per "second" is passed through AG-3 gate and also through EO-2 gate in the hour signal gate 107 to be applied to the hour counter 104, thereby causing an acelerated time counting as well as display to be effected at a rate of changing one digit in the hour counter per "second". When the hour setting is established, the common contact SW of the change-over switch 10 is moved to the minute adjusting contact S, whereby a logical "1 " signal is applied through OR-1 gate in the hold gate 108 to the input of the inverter INV of the "second" signal gate 105, causing a logical "0 " output to be produced therefrom to disable AG-1 gate. Thus, the "second" signal can not be inputted into the "second" counter 102. On the other hand, a logical "1 " signal is applied to one input of AG-2 gate in the time controlling gate 109, enabling this gate and permitting the "second" signal continuously supplied from the frequency divider 101 at a rate of one pulse per "second" to be passed therethrough and applied to the minute counter 103 through EO-1 gate in the minute signal gate 106, thereby causing an accelerated minute counting as well as associated display to be effected at a rate of changing one digit in the minute counter each second. The connection of the common contact SW with the minute adjusting contact S causes a logical "0 " signal to be applied to one input of OR-2 gate in the "second" reset gate 110, whereby a reset signal is applied to the reset terminal of all of the flipflops within the "second" counter 102. Thus, the "second" counter 102 has a count of 00 "second", and since no "second" signal is inputted from AG-1 gate of the "second" signal 105, the counter content is maintained at 00 "second". When the time display has proceeded to provide a desired minute representation, the common contact SW is moved to the hold contact II to maintain the counter at 00 "second" position of a given hour and minute representation. When the correct time announcement indicates 00 "second" of the given hour and minute representtation, the common contact SW is moved to the clock signal input position T to complete a time setting, by a simple and smooth operation, to the 00 "second" of a correct time such as may be provided by an announcement of time from a radio.

Where the car clock according to the invention is used in a car rally running over a long distance, for example, it is neccessary to provide an integration of actual running time beginning with 00 hour 00 minute 00 "second". In this instance, the common contact SW of the change-over switch 10 is connected to the reset contact R. At this time, AG-2 and AG-3 gates in the time controlling gate 109 are disabled, and a logical "1 " signal is applied to the reset terminal of all of the flipflop circuits contained in the frequency divider 101, the "second" counter 102, the minute counter 103 and the hour counter 104, thereby resetting the counter content to 0 to provide a time display of 00 hour 00 minute 00 "second" 00. The clock counter as well as the display are maintained in this condition. The common contact SW is then moved to the clock signal input position T at the time the car is started, thereby initiating time counting starting from the 00 hour 00 minute 00 "second" position. The common contact SW is moved to the hold contact H when the car is stopped, and is again connected with the clock signal input position T when the car is restarted. In this manner, by moving the common contact SW between the clock signal input position T and the hold contact H, the running time can be integtated in terms of hours, minutes and "second".

Alternatively, the car clock described may be used as a stop watch indicating minutes and "second" elapsed by resetting the clock counter to 00 hour 00 minute 00 second and connecting the common contact SW with the hold contact H at a desired time subsequent to the initiation of running the counter. Where a "second" display is not provided, the car clock may be converted into a stop watch capable of displaying integrated minutes and "seconds" by initially resetting the hour, minute and "second" counters to 00 hour 00 minute 00 "second", and connecting the common contact SW with the minute adjusting contact S at the time integration is to be started. In this instance, AG-2 gate in the time controlling gate 109 is enable to pass a "second" signal outputted from the frequency divider 101 to be applied through EO-1 gate in the minute signal gate 106 to the minute counter 103, thereby causing this counter to count the "second" signal as if it were a minute signal and thus producing an hour signal (which is in actuality a minute signal) to the input of the hour counter 104. In this manner, the hour counter 104 will count one hour in a time interval of one minute to provide a display of minutes on the hour display, while a display of "seconds" is provided by the minute display. With a clock incorporating a scale of 24 hour counter, a time integration from 00 minute 00 "second" to 25 minute 59 "second" can be obtained, while with a clock incorporating a scale of 60 hour counter 104, a time integration from 00 minute 00 "second" to 59 minutes 59 "seconds" can be obtained. At the end of the time integration, the common contact SW may be moved to the hold contact H to provide an indication of the integrated time. Subsequently, the common contact SW may be again connected with the minute adjusting contact S to provide a further integration of time. Alternatively, the hour counter 104 may comprise a pair of counters each having a full count of 12 and 60, respectively, and which are alternately connected into the circuit so as to provide a car clock covering 12 hours (or 24 hours) and a stop watch covering 60 minutes.

Thus, the provision in the present embodiment of the reset circuit which resets the count of all of the counters to zero, the hold circuit for maintaining the content in the respective counters at given values, and the hour and minute adjusting circuit which permits both or either one of the minute and hour counters to be counted up in an accelerated manner provides the car clock of this embodiment with various functions, that is the clock function running in the usual manner, the stop watch function capable of displaying hours and minutes (and "seconds" where a "second" display is provided) by resetting the counter content to 00 hour 00 minute 00 "second" 00 at the start of the counting and thereafter running the counters, and the time integrating function by running the time counting from the reset position of 00 hour 00 minute and connecting the common contact SW with the hold contact H to maintain the counter content at a desired position in time, and if required by repeating the time counting and holding steps to provide a display of hours and minute (and "seconds" where a "second" display is provided) integrated over several intervals.

Another feature of the present embodiment is the arrangement of the reset position, clock signal input position, hold position, minute adjusting position and hour adjusting position in the sequence named. Thus, the common contact SW can be moved from the clock signal input position to the reset position directly, but it can not be moved to either the minute adjusting position or the hour adjusting position from the clock signal input position unless it has moved past the hold position. Where it is desired to render a "second" reset circuit independent from the remainder and to isolate it from the circuit associated with the minute adjusting contact S, it is possible to achieve a similar effect by providing a separate "second" reset contact connected with a "second" reset circuit intermediate the hold contact H and the minute adjusting contact S, and by arranging the contacts of the change-over switch 10 in the sequence of the reset contact R, clock signal input position T, hold contact H, "second" reset contact, minute adjusting contact S and hour adjusting contact F or vice versa. When moving the common contact SW from the minute adjusting contact S, pase the second reset contact to the hold contact H, a connection is made with the "second" reset contact, whereby a "second" reset signal is inputted through the "second" reset circuit into the "second" counter 102, thereby resetting the count thereof to 00 "second".

Figure 5:
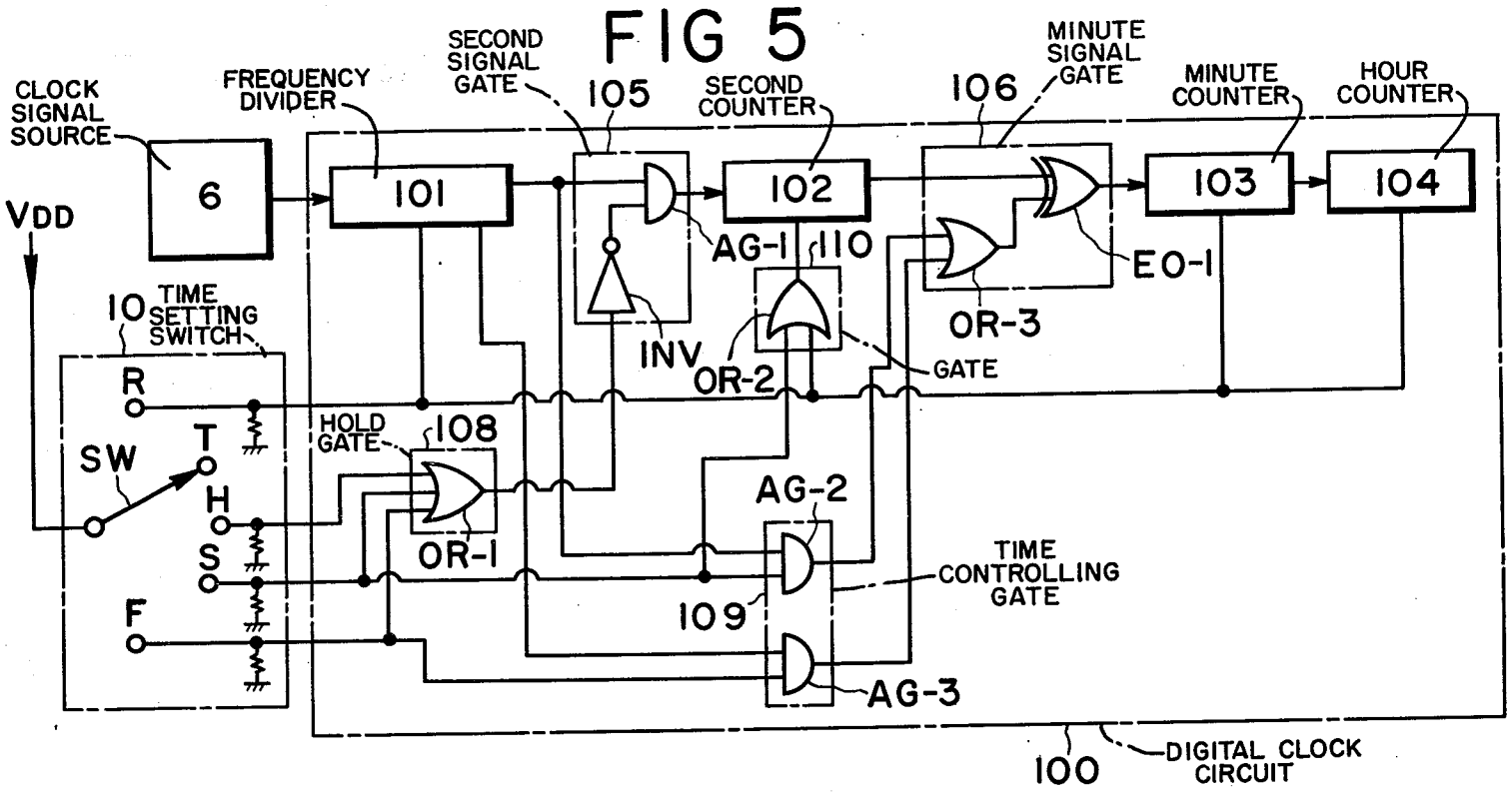

FIG. 5 shows another embodiment of the invention which is similar to the embodiment of FIG. 4 except that the input and output connection of AG-3 gate in the time controlling gate 109 are different, that a different number of inputs to the minute signal gate 106 are used, and that the hour signal gate 107 is removed. In this embodiment, the output signal from the frequency divider 101, which is produced at a rate of one pulse per "second" is inputted into AG-1 gate in the "second" signal gate 105 as well as AG-2 gate in the time controlling gate 109 as before, but is not inputted into AG-3 gate in the gate 109. Instead, an input to AG-3 gate in the time controlling gate 109 is derived in the form of a rapid rate signal (for example, having a rate of 60 pulse per "second") taken out of the frequency divider 101 before completion of the frequency division. The "second" signal gate 106 of this embodiment comprises an exclusive OR gate EO-1 and an OR gate OR-3, the OR-3 gate being connected to the output circuits of the time controlling gate 109, and the inputs to EO-1 gate being connected to the output of OR-3 gate and the output of the "second" counter 102.

During the normal use of the clock, the signal from clock signal source 6 in inputted into the frequency divider 101 wherein it is successively counted down by means of flipflops. A signal having a higher rate, or one derived before the completion of the frequency division is inputted into AG-3 gate in the time controlling gate 109, while the "second" signal, produced at a rate of one pulse per "second", is inputted into AG-1 gate in the "second" signal gate 105 and into AG-2 gate in the time controlling gate 109. When the common contact SW is connected with the clock signal input position T, both AG-2 and AG-2 gates of the time controlling gate 109 are disabled and therefore can not produce an output, while AG-1 gate in the "second" signal gate 105 is enable, whereby the "second" signal frequency divided by the frequency divider 101 is passed through AG-1 gate in the "second" signal 105 to be inputted into the "second" counter 102 for counting of "seconds". The "second" counter 102 outputs a minute signal at a rate of one pulse per 60 "seconds", which minute signal is passed through EO-1 gate in the minute signal gate 106 to be inputted into the minuted counter 103 for counting and display of minutes. An hour signal is outputted from the minute counter 103 at a rate of one pulse per 60 minutes and is inputted into the hour counter 104 for counting and display of hours. The arrangement of the contacts of the change-over switch 10 is the same as described above in connection with embodiment shown in FIG. 4. In the present embodiment, when it is required to reset the clock, the common contact SW is moved to the hour adjusting contact F (rapid adjusting contact) whereby AG-1 gate in the "second" signal gate 105 is disabled such that the "second" signal can no longer be inputted into the "second" counter 102. At the same time, AG-2 gate in the time controlling gate 109 is also disable and can not produce an output signal. On the other hand, the AG-3 gate in the time controlling gate 109 is enabled, such that a signal having the higher rate is inputted from the frequency divider 101 into OR -3 gate and EO-1 gate in the minute signal gate 106, and thence inputted into the minute counter 103, causing an accelerated counting thereof. For example, when a signal having the rate of 60 pulses per "second" is inputted into the minute counter 103, a count of up to 60 minutes can be completed within one "second", whereupon the minute counter 103 outputs a signal into the hour counter 104, thus enabling an accelerated counting within the hour counter. When a desired hour and minute representation is approached during such an accelerated counting, the common contact SW is moved to the minute adjusting contact S (low rate adjusting contact), whereby AG-3 gate in the time controlling gate 109 and AG-1 gate in the "second" signal gate 105 are disabled and at the same time AG-2 gate in the time controlling gate 109 is enabled to output a "second" signal, which is passed through OR-3 gate and EO-1 gate in the minute signal gate 106 to be inputted into the minute 103, thus permitting a time setting to be effected at a rate one digit in the minute counter per "second". Since the low rate adjusting contact S now assumes a logical "1 " level, a "second" reset signal is inputted into the "second" counter 102, resetting its count to 00 "second" and allowing the clock to be maintained at 00 "second" when the counting of the counters is stopped at a desired hour and minute representation. The function achieved by the reset contact R and the hold contact H is similar to that described in connection with the embodiment shown in FIG. 4, the only difference being the circuit associated with the hour adjusting contact F (rapid adjusting contact). Th same effect is achieved in this embodiment as described previously, but it can not be accomplished if the sequence of the contacts is altered.

Figure 6:
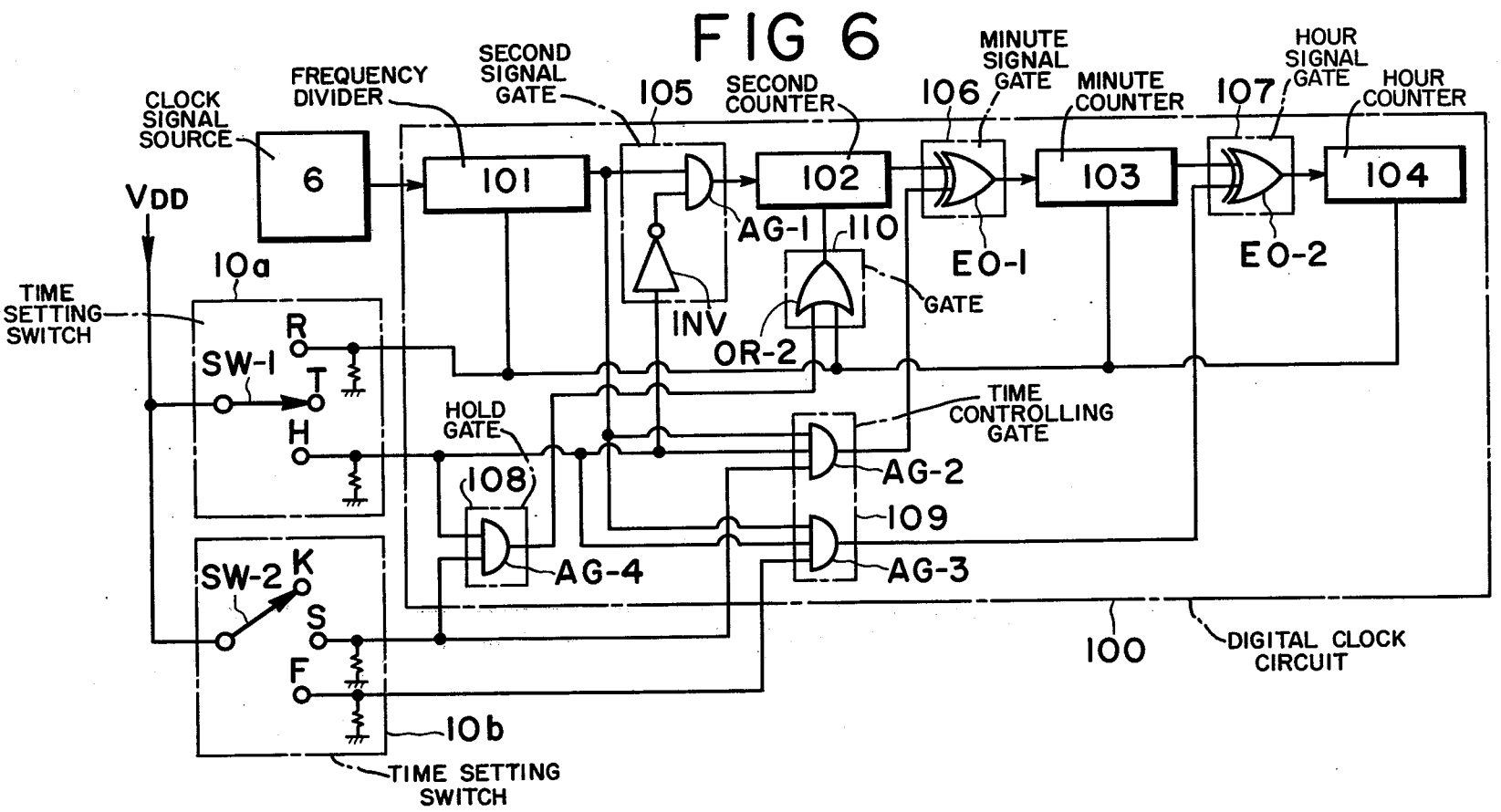

FIG. 6 shows a further embodiment which uses a pair of time setting switches 10*a* and 10*b*. The change-over switch 10*a* includes a contact designated as clock signal input position T which remains unconnected, another contact designated as hold contact H which is connected to the hold gate 108, time controlling gate 105, and a further contact designated as reset contact R which is connected with the reset circuits of the frequency divider 101, the "second" counter 102, and the minute counter 103 and the hour counter 104. The connection with the "second" counter 102 is effected through the "second" reset gate 110. The change switch 10*b* includes an off contact K which remains unconnected, another contact designated as minute adjusting contact S which is connected to the hold gate 108 and AG-2 gate in the time controlling gate 109, and a further contact designated as hour adjusting contact F which is connected to AF-5 gate in the time controlling gate 109. Except for the clock signal input position T in the change-over switch 10*a* and the off contact K in the change-over switch 10*b*, each of the contacts, R, H, S and F is connected with the ground to provide a logical "0 " level normally. The change-over switch 10*a* includes a common contact Sw-1 connected to a source of operating voltage $V_{DD}$ so as to provide a logical "1 " signal to the circuit associated with each of the contacts T, H and R to which it is switched. Similarly, the change-over switch 10*b* includes a common contact SW-2 connected to the same source of operating voltage $V_{DD}$ so as to provide a logical "1" level to the circuit associated with each of the contacts K, S and F to which it is switched.

One of the features of the present embodiment is the selective sequence of the contacts in the respective change-over switches 10*a* and 10*b*. Specifically, the contacts sequence of the change-over switch 10*a* is reset contact R, clock signal input position T and hold contact H or vice versa. The sequence of contacts of the change-over switch 10*b* is off contact K, minute adjusting contact S and hour adjusting contact F or vice versa.

The remaining circuit arrangement and the operation of this embodiment during its normal use are similar to that previously desribed in connection with FIG. 4, and therefore will not be described in detail. Briefly, when it is desired to set the clock, the common contact SW-1 of the change-over switch 10*a* is moved so as to connect with the hold contact H, whereby a logical "1 " signal is applied to the input of the inverter INV of the "second" signal gate 105 and thereby to apply a logical "0 " signal to the AG-1 gate which disables gate 105. As a consequence, the "second" signal from the frequency divider 101 can no longer pass through AG-1 gate to be inputted into the "second" counter 102. A logical "1 " signal is also inputted to one each of the three input gates of AG-2 and AG-3 in time controlling gate 109 which are connected to the hold contact H. If the common contact SW-2 of the change-over switch 10*b* is now moved to be connected to the hour adjusting contact F, AG-3 gate is enabled to pass the "second" signal supplied from the frequency divider 101 therethrough. This, in turn, is fed through ED-2 gate in the hour signal gate 107 into the hour counter 104. Thus, an accelerated counting at a rate of one digit in the hour counter per "second" is performed. When the desired hour representation is approached, the common contact SW-2 of change-over switch 10*b* is moved so as to connect with the minute adjusting contact S, whereupon AG-3 gate is disabled to prevent a further adjustment of the hours. Simultaneously AG-1 in the "second" signal gate 105 remains disabled. Since the minute adjusting contact S now assumes a logical "1 " level, this signal is outputted from AG-4 gate in the hold gate 108 to be fed through OR-2 gate in the "second" reset gate 110 and applied to the reset terminal of the "second" counter 102, resetting its count to 0. At the same time, a logical "1 " signal is applied to AG-2 gate in the time controlling gate 109 thus enabling this gate, whereby the "second" signal supplied from the frequency divider 101 is passed therethrough and fed through EO-1 gate in the minute signal gate 106 to the input of the minute counter 103. This causes an accelerated counting therein at a rate of one digit per "second" . When the desired minute representation is approached, the common contact SW-2 of the change-over switch 10*b* is moved to the off contact K, whereby the AG-2 and AG-3 gates in the time controlling gate 109 are disabled to prevent a further adjustment of the hours and minutes. However, because the common contact SW-1 of the change-over switch 10*a* remains connected to the hold contact H, the output from the inverter INV of the "second" signal gate 105 remains at a logical "" level, whereby AG-1 gate is also disabled to prevent the "second" signal from being inputted into the "second" counter 102. Thus, all of the hour, minute and "second" counters are stopped in their operation to maintain 00 second at a desired hour and minute representation. When a time announcement is made over a radio, for example, indicating 00 "second" at the desired hour and minute position, the common contact SW-1 of the change-over switch 10*a* is moved so as to be connected with the clock signal input position T, whereby the input to the inverter INV of the "second" signal gate 105 returns to a logical "0 " level. This enables AG-1 gate connected with its output to pass the "second" signal into the "second" counter 102, thereby initiating the counting of "seconds" beginning from 00 "second", as described previously in connection with the normal use of the clock in the preceding embodiments.

Figure 7:
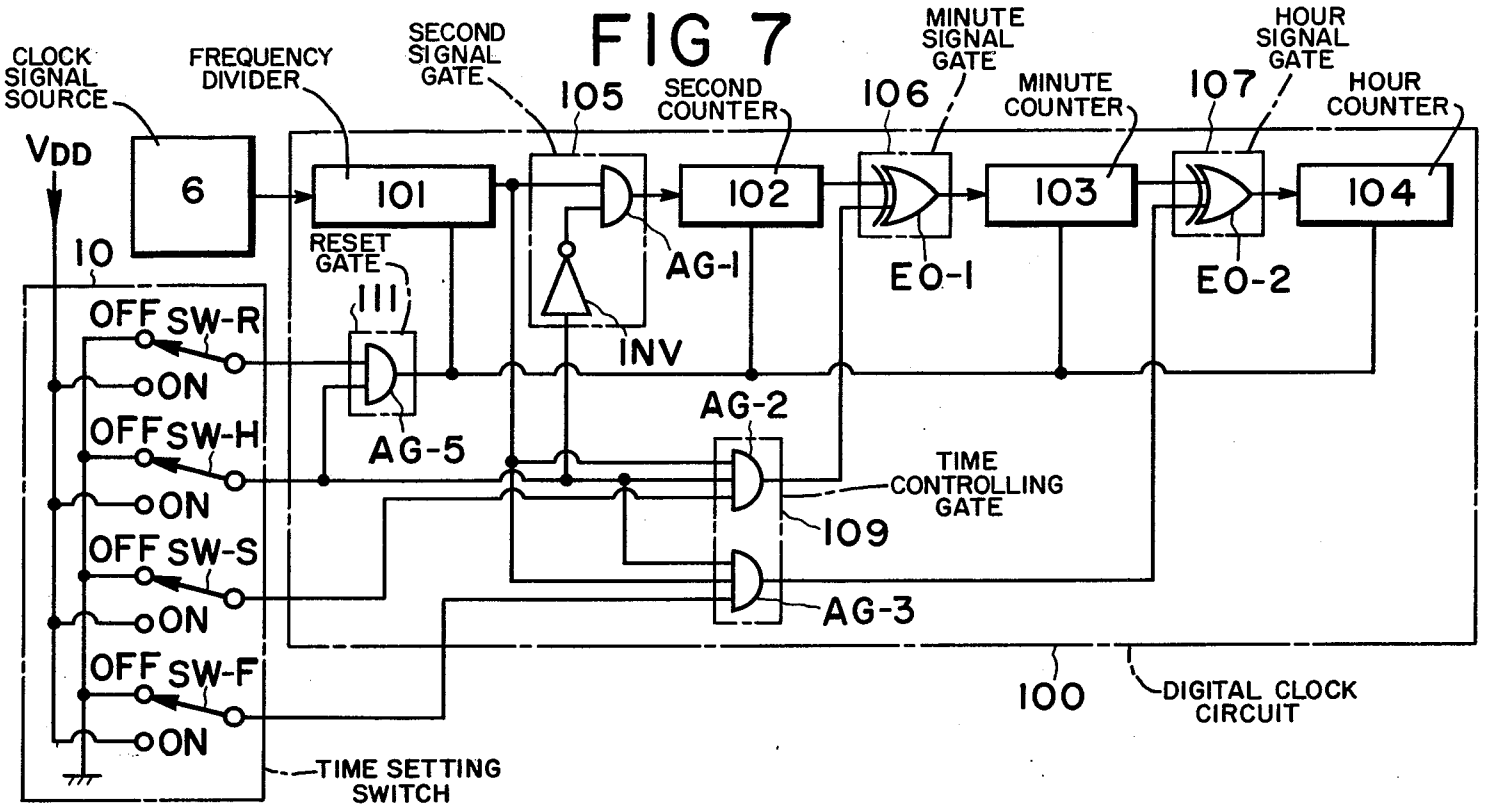

FIG. 7 shows an alternative embodiment in which the time setting switch 10 comprises a plurality of discrete switches, the selective operation of which permits a time setting operation. Specifically, switch 10 includes a hold switch SW-H which is connected with the input circuits of the "second" signal gate 105, the time controlling gate 109 and a reset gate 111; a minute adjusting switch SW-S connected with the input circuit of AG-2 gate in the time controlling gate 109; an hour adjusting switch SW-F connected with the input circuit of AG-3 gate in the time controlling gate 109; and a reset switch SW-R connected with the input circuit of the reset gate 111. Each of the switches SW-H, SW-S, SW-F and SW-R has an OFF position in which it is connected to the ground to provide a logical "0 " level. Each of these switches also has an ON position in which it is connected with a source of operating voltage $V_{DD}$ to provide a logical "1 " level.

During the normal use of the clock, all of the switches SW-H, SW-S, SW-F and SW-R are in their OFF position, whereby a logical "0 " signal is applied to the various circuits connected with these switches. Thus, AG-2 and AG-3 gates in the time controlling gate 109 as well as AG-5 gate in the reset gate 111 are disabled and can not output a signal. Since a logical "0 " signal is also applied to the input of the inverter INV in the "second" signal gate 105 which is connected with the hold switch SW-H, its output provides a logical "1 " signal which is inputted into AG-1 gate to enable it, whereby the "second" signal supplied from the frequency divider 101 at a rate of one pulse per "second" is passed therethrough to be inputted into the "second"

counter 102. This in turn operates the minute counter 103 and the hour counter 104 successively, and the normal time counting proceeds.

When it is desired to effect time setting at the commencement of use or during the use of the clock, the hold switch SW-H is turned on to permit time setting. When the hold switch SW-H is turned on, a logical "1 " signal ($V_{DD}$) is applied to one input of the two input AND gate AG-5 of the reset gate 111. However this AND gate remains disabled because its other input is connected to ground. A logical "1 " signal is also applied to the input of the inverter INV in the "second" signal gate 105 and is reversed in polarity at its output which is connected with one input of AG-1 gate, thereby disabling this AND gate preventing the output signal from the frequency divider 101 from passing through AG-1 gate. As a result, no signal is fed into the "second" counter 102, so that the counting of "seconds", minutes and hours is stopped or the content in the respective counters is maintained or remains unchanged. As a result of turning on the hold switch SW-H, each of three input AND gate AG-2 and AG-3 in the time controlling gate 109 receives two logical "" signals. If now the minute adjusting switch SW-S is turned on, a logical "1 " signal is applied to the third input of AG-2 gate in the time controlling gate 109, whereby AG-2 gate is enabled to pass the "second" signal outputted from the frequency divider 101 at a rate of one pulse per "second". This signal is fed through EO-1 gate in the minute signal gate 106 and inputted into the minute counter 103, thereby causing an accelerated counting at a rate of one minute per "second".

Where a deviation of the time display from a correct time is substantial, the hour adjusting switch SW-F may be turned on to permit an accelerated counting in the hour counter. Thus, when the minute adjusting switch SW-S is turned off and the hour adjusting switch SW-F is turned on, a logical "1 " signal is supplied to the third input of AG-3 gate in the time controlling gate 109, whereby AG-3 gate is enabled to pass the "second" signal from the frequency divider 101. This signal is fed through EO-2 gate in the hour signal gate 107 to the input of the hour counter 104, thereby causing an accelerated counting at a rate of one hour per "second".

It will be appreciated that both of the minute adjusting switch SW-S and the hour adjusting switch SW-F may be turned on simultaneously to permit an acclerated counting of both minutes and hours. In this instance, when the time display has proceeded to the given hours and minutes, the hold switch SW-H is turned off to disable AG-2 and AG-3 gates in the time controlling gate 109. The output of the inverter INV in the "second" signal gate 105 produces a logical "1 " at one input of AG-1 gate, which is therefore enabled to pass the "second" signal into the "second" counter 102 in order to permit a counting of time in a normal manner.

If the reset switch SW-R is turned on while the hold switch SW-H is turned on, AF-5 gate in the reset gate 111 is enabled to produce a reset signal, which is inputted into the frequency divider 101, the "second" counter 102, the minute counter 103 and the hour counter 104, thereby resetting the count of the frequency divider 101 and all of the counters 102, 103 and 104 to 00 hour 00 minute 00 "second" 00. If the reset switch SW-R is turned off subsequently, the hold switch SW-H is maintained on alone, thus maintaining a representation of 00 hour 00 minute 00 "second". When the hold switch SW-H is turned off, the clock assumes a normal condition, initiating the counting of time beginning from 00 hour 00 minute 00 "second". By turning the hold switch SW-H on and off at desired times, an integration of hours, minutes and "seconds" can be achieved. By turning reset switch SW-R on to reset the display to 00 hour 00 minute 00 "second" subsequent to the turning on of the hold switch SW-H, the clock may be operated as a stop watch.

Figure 8:
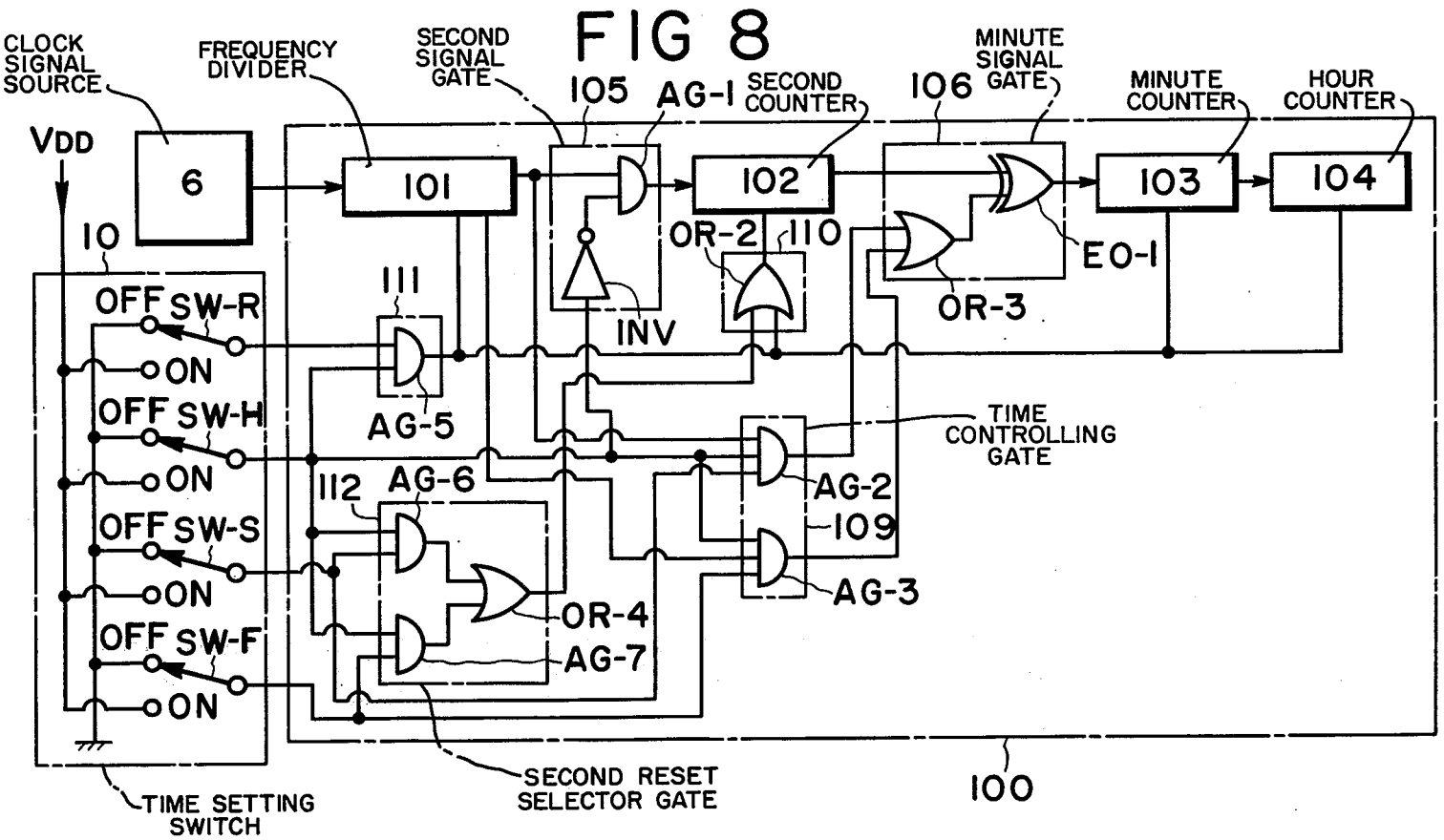

FIG. 8 shows an additional embodiment of the invention which incorporates a plurality of discrete change-over switches which constitute together the switch 10, as in FIG. 7, to permit time setting of the clock by selective operation of the discrete change-over switches. Major differences between the embodiments shown in FIGS. 8 and 7 are that a "second" reset selection gate 112 is additionally provided, that different input and output connections are used for the time controlling gate 109, that a different number of inputs are used with the minute signal gate 106, and that the time signal gate 107 is eliminated. In the present embodiment, the "second" reset selection gate 112 comprises a pair of tow input AND gates AG-6, AF-7 and an OR gate OR-4. The inputs to AF-6 gate are connected with the hold switch SW-H and the low rate adjusting switch SW-S, while the inputs to AG-7 gate are connected with the hold switch SW-H and the high rate adjusting switch SW-F. The outputs from AG-6 and AG-7 gates are connected to the inputs of OR-4 gate, the output of which is connected to one input of the "second" reset gate 110. The output signal from the frequency divider 101 which is produced at a rate of one pulse "second" is inputted into AG-1 gate in the "second" signal gate 105 and AG-2 gate in the time controlling gate 109, but is not inputted into AG-3 of the gate 109. Signal having a higher repetitive rate than the "second" signal, for example, having a rate of 60 pulses per "second", is derived from the frequency divider 101 and is inputted into AG-3 gate of the time controlling gate 109, the output of which is connected to one input of OR-3 gate in the minute signal gate 106. The switch 10 includes the hold switch SW-H which is connected with the "second" signal gate 105, time controlling gate 109, "second" reset selection gate 112 and reset gate 111; the low rate adjusting switch SW-S which is connected with the time controlling gate 109 and the "second" seret selection gate 112; and the reset switch SW-R connected with the reset gate 111. As in the embodiment shown in FIG. 7, each of these switches is connected with the ground to provide a logical "0 " signal in their OFF position, and is connected with a source of voltage $V_{DD}$ to provide a logical "" signal in its ON position. In the energized condition of the system, the "second" signal produced at a rate of one pulse per "second" from the frequency divider 101 continues to be inputted into AG-1 gate in the "second" signal gate 105 and AG-2 gate in the time controlling gate 109, as mentioned previously in connection with the embodiment of FIG. 5. A signal having a higher repetitive rate (for example, having a rate of one pulse per 0.02 "second") is derived from the frequency divider 101, and is always inputted into AG-3 gate in the time controlling gate 109 as a high rate time adjusting signal. During the normal use of the clock, hold switch SW-H, low rate adjusting switch SW-S, high rate adjusting switch SW-F and reset switch SW-R are in their OFF position, so that a logical "0 " is inputted into AG-2, AG-3, AG-5, AG-6 and AG-7 gates connected with these switches so as to disable them. As a consequence, the signal which continues to be inputted into AG-2 and AG-3 gates of the time controlling gate 109 from the frequency divider 101 can not be outputted from these gates. Since a logical "0 " signal is applied to the inverter INV in the "second" signal gate 105 which is connected with the hold switch SW-F, the inverter provides a logical "1 " signal at its output, which is inputted into one input of AG-1 gate of the gate 105, thereby enabling AG-1 gate to pass the "second" signal outputted from the frequency divider 101 therethrough. The "second" signal which passed through AG-1 gate is inputted into the "second" counter 102, and the subequent operation is similar to that described in connection with the previous embodiments.

When it is desired to effect a time setting at the beginning of use of during use, such a time setting is enabled by turning on the hold switch SW-H. When the hold switch SW-H is turned on, a logical "1 " signal ($V_{DD}$) is inverter to one input of AG-6 and AG-7 gates in the "second" reset selection gate 112 as well as to one input of a two input AND gate AG-5 in the reset gate 111, but these AND gates produce no output. A logical "1" signal is also applied to the input of the inverter INV in the "second" signal gate 105, whereby the polarity is reversed at its output to disable AG-1 gate, thereby preventing the passage of the output signal from the frequency divider 101 through AG-1 gate. As a result, no signal is inputted into the "second" counter 102, so that all of the "second," minute and hour counters are no longer operated and maintain their count. The three input AND gates AG-2 and AG-3 in the time controlling gate 109 receive a logical "1" signal in addition to the output signal from the frequency divider 101, and thus has two of their three inputs in the logical "1" level. When the low rate adjusting switch SW-S is turned on under this condition, a logical "1" signal is inputed into AG-6 gate in the "second" reset selection gate 112 to enable it, whereby AG-6 gate outputs a reset signal, which is passed through OR-5 gate and OR-4 gate in the "second" reset gate 110 to be inputted into the reset terminal of the "second" counter 102, thereby resetting the count of the "second" counter 102 to 0. Thus, the "second+ counter 102 has a count of 00 "second," and subsequently counts up, proceeding 01, 02 . . . . as the "second"signal is inputted from AG-1 gate in the "second" signal gate 105. Since a third input is applied from the low rate adjusting switch SW-S to AG-2 gate in the time controlling gate 109 which has its two inputs energized, AG-2 gate is enabled to pass the "second" signal outputted from the frequency divider 101 therethrough, the "second" signal being subsequently passed through OR-3 gate EO-1 gate in the minute signal gate 106 to be inputted into the minute counter 105, thereby permitting an accelerated counting to proceed therein at a rate of one digit in the minute counter per "second." When a deviation from the correct time in great, the high rate adjusting switch SW-F may be turned on to permit an accelerated counting of hours and minutes. when the high rate adjusting switch SW-F is turned on, a logical "1" signal is inputted into AG-3 gate in the time controlling gate 109 to enable it, whereby a signal having a higher repetitive rate (for example, a rate of one pulse per 0.02 "second") which is outputted from the frequency divider 101 is passed therethrough and through OR-1 gate in the minute signal gate 106 to be inputted into the minute counter 105, thereby causing an accelerated counting of minutes and hours to proceed. For example, if the signal having the higher repetitive rate which is derived from the frequency divider 101 and inputted into AG-3 gate of the time controlling gate 109 had a rate of 60 pulse per "second", the counting rate in the hour counter 104 will be such that one hour therein is varied in one "second." It will be appreciated that the rate of the higher rate adjusting signal depends on the position of that one of the flipflops contained for the purpose of frequency division in the frequency divider 101 from which the signal is derived. It should be understood that when the high rate adjusting switch SW-F is turned on, the low rate adjusting switch SW-S is previously turned off.

When a time setting is referenced to a time announcement from a radio, for example, the hold switch SW-H is turned on together with the reset switch SW-R to maintain the count in the "second" counter at 00 "second," and the high rate adjusting switch SW-F and the low rate adjusting switch SW-S may be operated to produce a desired hour and minute representation in the hour and minute counters. Subsequently, all the switches except the hold switch SW-H is turned off, and when the announcement is made at 00"second" of the desired time, the hold switch SW-H is turned off to return the clock to the normal operation condition, whereafter the counting and display of time proceeds in the usual manner.

Alternatively, the reset switch SW-R may be turned on while maintaining the hold switch SW-H in its ON position to stop the counting of time. Thereupon, AG-5 gate in the reset gate 111 is enabled to produce a reset signal, which is inputted to the frequency divider 101, "second" counter 102, minute counter 103 and hour counter 104, thereby resetting the count of all these counters and frequency divider to 00. The reset signal to the "second" counter 102 is applied through OR-4 gate in the "second" reset gate 110. Subsequently, the reset switch SW-R is turned off and only the reset switch SW-H is maintained in its ON position to maintain the count of 00 hour 00 minute 00"second". When the hold switch SW-H is turned off, the clock is in its normal condition to start the counting of time from 00 hour 00 minute 00"second," and an integration of hours, minutes and "second" can be provided by turning the hold switch SW-H on and off at desired times. Alternatively, the hold switch SW-H may be turned on, followed by turning on of the reset switch SW-R to reset the count to 00 hour 00 minute 00"second", whereby the clock may be used as a stop watch.

While the invention has been described above in connection with preferred embodiments, it should be understood that the invention is not limited to these specific embodiments, but that various changes and modifications in circuit arrangement and details can be made by one skilled in the art without departing from the true spirit and scope of the invention defined by the appended claims. While the embodiments have been described as applied to a car clock, it should be understood that the invention can equally be applied to autobicycle, marine vessel, in particular motor boat, or aircraft.

Having described the invention, what is claimed is:

1. A car clock with digital display comprising an electric storage battery of a car, an engine key switch electrically connected with the battery, a clock counter circuit connected with the battery, and a clock display electrically connected with the battery through the engine key switch, whereby when the engine key switch is changed to either start or run position, the clock display is energized to provide a digital display of time represented by the count in the clock counter while when the engine key switch is changed to a stop position, the clock display is deenergized while the clock counter circuit continues to operate.

2. A car clock with digital display according to claim 1 in which the clock counter circuit comprises a frequency divider, a "second" counter, a minute counter and an hour counter, and further including a reset circuit which is operative to reset at least some of the counters, a hold circuit for maintaining the count in the respective counters of predetermined counts, an hour and minute adjusting circuit for causing an accelerated counting to occur in at least one of the minute and hour counters, a selection switch for selectively enabling the adjusting circuit to effect an accelerated counting in either one of minute the and hour counters, said frequency divider producing a "second" signal at a rate of one per "second," and said adjusting circuit being operative, when enabled by the selection switch, to input the "second" signal into the minute counter directly without passing through the "second" counter, whereby a minute display associated with the minute counter is able to provide a display of "seconds".

3. A car clock with digital display according to claim 1 in which the clock counter circuit comprises a frequency divider, a "second" counter, a minute counter and an hour counter, and further including a a reset circuit for resetting at least some of the counters, a hold circuit for maintaining the count in the respective counters at predetermined counts, an hour and minute adjusting circuit for causing an accelerated counting to occur in at least one of the minute and hour counters, and a time setting change-over switch including a plurality of contacts representing a reset position, a clock signal input position, a hold position, a minute adjusting position and an hour adjusting position.

4. A car clock with digital display according to claim 1 in which the clock counter circuit comprises a frequency divider, a "second" counter, a minute counter and an hour counter, and further including a reset circuit for resetting at least some of the counters, a hold circuit for maintaining the count in the respective counts at predetermined counts, an hour and minute adjusting circuit for causing an accelerated counting to occur in at least one of the minute and hour counters, and a first time setting change-over switch having a plurality of contacts representing a reset position, a clock signal input position and a hold position, and a second time setting change-over switch having a plurality of contacts representing an off position and an hour and minute adjusting position.

5. A car clock with digital display according to claim 2 in which the selection switch comprises a group of discrete switches including at least a hold switch, a pair of time setting adjusting switches and a reset switch.

6. A car clock with digital display in which a clock display is energized to provide a display of time counted by a clock counter circuit when an engine key switch of a car is changed to a start or run position, and is deenergized when the engine key switch is changed to a stop position while operating the clock counter circuit, the car clock including a selector switch arrangement permitting a time setting to be performed, characterized in that said selector switch arrangement has a clock pulse input position and an hour-minute adjusting position as well as a hold position and that upon time setting, the switch arrangement cannot be changed from the clock pulse input position to the hour and minute adjusting position unless it first assumes a hold position during the switching process.

7. The clock according to claim 6 in which the selector switch arrangement includes a selector switch having a plurality of contacts representing a reset position, a clock signal input position and a hold position which are arranged in the sequence so named so that the switch can not be moved to another position unless it has moved past the hold position.

8. The clock according to claim 6 in which the selector switch has a plurality of contacts representing a reset position, a clock signal input position, a hold position, a minute adjusting position and an hour adjusting position which are arranged in the sequence named, whereby permitting the switch to be moved from the clock signal input position to the reset position directly, but preventing the switch from being moved the clock signal input position to the minute adjusting position or the hour adjusting position unless it has moved past the hold position.

9. The clock according to claim 6 in which said selector switch arrangement includes a first selector switch including the clock signal input position and the hold position, and another selector switch which permits selection between an hour adjusting position and a minute adjusting position, characterized in that an hour or minute adjustment under the control of said other selector switch can not be performed unless the first mentioned selector switch is connected with the hold position.

10. The clock according to claim 6 in which the clock counter circuit comprises a frequency divider, a "second" counter, a minute counter and an hour counter, and further includes a reset circuit for resetting part or all of the counter circuits, a hold circuit for maintaining the count in the respective counters at predetermined counts, an hour and minute adjusting circuit for causing an accelerated counting to occur in at least one of the minute and hour counters; said switch arrangement including a first selector switch having a reset position, a clock signal input position and a hold position, and a second change-over switch including an hour adjusting position and a minute adjusting position; characterized in that an hour or minute adjustment under the control of the second change-over switch can not be performed unless the first change-over switch is connected with the hold position.

11. The clock according to claim 6 in which the selector switch arrangement includes a hold switch, a pair of time setting adjusting switches and a reset switch, all of which are discrete switches, characterized in that upon time setting; an hour or minute adjustment under the control of the adjusting switch can not be performed unless the hold switch is in a position in which a signal is inputted to a "second" counter contained in the clock counter circuit.

12. The clock according to claim 6 in which the clock counter circuit comprises a frequency divider, a "second" counter, a minute counter and an hour counter, and in which the car clock further include a reset circular for resetting at least some of the counters, a hold circuit for maintaining the count in the respective counters at predetermined counts, an hour and minute adjusting circuit for causing an accelerated counting to occur in at least one of the minute and hour counters, said selector switch arrangement including a group of discrete switches for enabling a time setting to be performed and including a hold switch, a pair of time setting adjusting switches and reset switch, characterized in that an hour or minute adjustment under the control of the adjusting switch can not be performed unless the hold switch is in its on position to prevent a signal from being inputted into the "second" counter, thereby interrupting the counting in the "second", minute and hour counters.

13. An electronic timepiece comprising a digital display and a counter circuit, the display being coupled to the counter circuit to provide a display of time counted by the counter circuit, the counter circuit including a second counter and a minute counter and an hour counter normally connected in cascade and inhibit means for inhibiting counting by said counters, a selector switch arrangement permitting time presetting and setting, characterized in that said selector switch arrangement has a normal operative position and an hour-minute adjusting position coupled to the minute and hour counters as well as a hold position coupled to the inhibit means and that upon time presetting, the switch arrangement being changeable from the hour and minute adjusting position to the normal operative position for carrying out the time setting operation only when it assumes a hold position during the switching process.

14. A timepiece as in claim 13, wherein said selector switch arrangement has an hour adjusting position, a minute adjusting position, a hold position, and a normal operation position.

15. The electronic timepiece as set forth in claim 14 wherein said inhibiting means comprises a plurality of inhibiting elements arranged between said selector arrangement and said counters and at the hour adjusting position of said selector switch arrangement, output signals from said second counter are introduced into said hour counter for execution of an hour adjusting operation, at the minute adjusting position of said selector, said output signals are fed to said minute counter for execution of a minute adjusting operation, at the hold position of said selector, all the said counters are caused to inhibit their counting operation and at normal operational position of said selector, all said counters are caused to perform their respective counting operation for the execution of normal operation of said timepiece.

16. The electronic timepiece as set forth in claim 14, wherein said hour-adjusting position, minute adjusting position, hold position and normal operation position arranged in the orders stated.

17. The electronic timepiece as set forth in claim 16, wherin said inhibit means includes an element connected with said selector switch, on the one hand, and with reset input of said second counter, on the other hand, and with said selector switch set to its hold position, the second counter being fed with a reset signal from said inhibiting element, so said second chamber is reset to its zero second state and held thereat.

18. A car clock with digital display in which the display is energized to provide a display of time counted by a clock counter circuit when an engine key switch of a car is changed to a start or run position, and is deenergized when the engine key switch is changed to a stop position while operating the clock counter circuit, the counter circuit including a frequency divider and a second counter, a minute counter and an hour counter connected normally in cascade one after another, the car clock including a time set switch arrangement permitting a time setting to be performed, said car clock being characterized in that said switch arrangement comprises an hour setting element and a minute setting element, wherein when the latter element is turned on, rapid feed signals are derived from said frequency divider or said second counter and fed to said minute counter, thereby performing minute display adjustment.

19. A car clock with digital display in which the display is energized to provide a display of time counted by a clock counter circuit when an engine key switch of a car is changed to a start or run position, and is deenergized when the engine key switch is changed to a stop position while operating the clock counter circuit, the counter circuit including a frequency divider and a second counter, a minute counter and an hour counter connected normally in cascade one after another, the car clock including a time set switch arrangement permitting time setting to be performed, said car clock being characterized in that said switch arrangement comprises an hour setting element and a minute setting element, wherein when the former element is turned on, rapid feed signals are derived from said frequency divider or said second counter and fed to said hour counter, thereby performing a hour display adjusting job.

20. A car clock with digital display in which the display is energized to provide a display of time counted by a clock counter circuit when an engine key switch of a car is set to a start or run position, and is deenergized when the engine key switch is changed to a stop position while operating the clock counter circuit, the counter circuit including a frequency divider and a second counter, a minute counter and an hour counter normally connected in cascade one after another, the car clock including a time set switch arrangement permitting a time setting to be performed, said car clock being characterized in that said switch arrangement comprises an hour setting element and a minute setting element, wherein when the former element is turned on, rapid feed signals of higher frequency than that appearing at minute display adjusting operation are derived from said frequency divider and fed to said minute counter, so as to adjust the hour display adjusting job.

* * * * *